US005483125A

United States Patent [19]

Kachmarik et al.

[11] Patent Number: 5,483,125

[45] Date of Patent: Jan. 9, 1996

[54] BALLAST CIRCUIT FOR A GAS DISCHARGE LAMP HAVING A CATHODE PRE-HEAT ARRANGEMENT

[75] Inventors: David J. Kachmarik, North Olmsted; Louis R. Nerone, Brecksville; Michael M. Secen, Mentor; Kurt W. Haas, Chesterland, all of Ohio

[73] Assignee: General Electric Company, Schenectady, N.Y.

[21] Appl. No.: 161,844

[22] Filed: Dec. 6, 1993

[51] Int. Cl.[6] ..... H05B 39/04

[52] U.S. Cl. ..... 315/106; 315/104; 315/200 R; 315/209 R; 315/DIG. 5

[58] Field of Search ..... 315/94, 100, 101, 315/104, 106, 200 R, 209 R, 291, DIG. 5, DIG. 7

[56] References Cited

U.S. PATENT DOCUMENTS

| | | | |
|---|---|---|---|
| 4,647,817 | 3/1987 | Fahnrich et al. | 315/104 |
| 4,782,268 | 11/1988 | Fahnrich et al. | 315/200 R |
| 5,027,033 | 6/1991 | Zuchtriegel | 315/106 |
| 5,122,712 | 6/1992 | Hirschmann | 315/106 |

*Primary Examiner*—Robert J. Pascal
*Assistant Examiner*—Haissa Philogene
*Attorney, Agent, or Firm*—George E. Hawranko; Stanley C. Corwin

[57] ABSTRACT

A ballast circuit for a gas discharge lamp, of the type having a pair of resistively heated cathodes that are resistively heated both during a cathode pre-heat period prior to lamp turn-on, and during steady state lamp operation, is disclosed. The ballast circuit includes circuitry for providing, on a bus conductor, a d.c. bus voltage with respect to a ground, and a converter, responsive to the d.c. bus voltage, for supplying bidirectional current to a resonant load circuit. The resonant load circuit includes the gas discharge lamp, a resonant capacitor coupled between the lamp cathodes such that its voltage varies with lamp voltage, and a resonant inductor serially coupled to the resonant capacitor and cooperating therewith to set a magnitude, and resonant frequency, of the bidirectional lamp current. Circuitry is provided for powering the resistively heated lamp cathodes, to thereby heat the cathodes. Further included is a circuit for maintaining the lamp voltage during a cathode pre-heat period below a predetermined level so as to prevent lamp turn-on during such period; such circuit includes circuitry for holding a first cathode of the lamp at a substantially constant voltage, and circuitry for clamping a second cathode of the lamp below the predetermined level. Such clamping circuitry includes a positive temperature coefficient (PTC) impedance device coupled to a second cathode of the lamp, and serially connected by a positively poled clamping diode to the bus conductor, and serially connected by a negatively poled clamping diode to the ground.

13 Claims, 4 Drawing Sheets

BALLAST CIRCUIT FOR A GAS DISCHARGE LAMP HAVING A CATHODE PRE-HEAT ARRANGEMENT

FIELD OF THE INVENTION

The present invention relates to a ballast circuit for a cathode-heated type of gas discharge lamp, such as a fluorescent lamp, and, more particularly, to improved performance of cathode-heating circuitry of such ballast circuit.

BACKGROUND OF THE INVENTION

Certain types of gas discharge lamps, such as one class of fluorescent lamps, include a pair of cathodes each of which incorporates an internal resistance that becomes heated when a respective current passes therethrough; such cathodes are referred to hereinafter as resistively heated cathodes. The "resistive" heating occurs both during steady state lamp operation, when the cathodes are also heated from an arc discharge in the lamp, and during a so-called cathode pre-heat period, prior to lamp turn-on. The cathodes of such lamps are designed to emit electrons during normal lamp operation. Such cathodes typically comprise tungsten or similar metal, which, when uncoated, is susceptible to fracturing when heated to emit electrons. The cathodes, therefore, are typically coated with an electron-emissive material, to facilitate electron emission, while protecting the cathode metal from fracturing.

It is desirable, in a fluorescent lamp of the mentioned type, for the cathodes to be heated to at least about 700° Centigrade (C) during the cathode pre-heat period, prior to lamp turn-on, to achieve a desired themionic emission of electrons from the cathodes. During steady state lamp operation, a continued heating of the cathodes, to about 500° C. is desirable to maintain a preferably, thermionic emission of electrons from the cathodes and long cathode life.

A typical power supply, or (as typically described) "ballast," circuit for a cathode-heated type of fluorescent gas discharge lamp utilizes a positive temperature coefficient (PTC) resistor in a circuit for heating the lamp cathodes, both during the cathode pre-heat period, and during steady state lamp operation. The gas discharge lamp has a pair of resistively heated cathodes, each of which has a respective terminal coupled to a resonant power supply circuit for supplying bidirectional current to the lamp. Across the other pair of cathode terminals, a positive temperature coefficient (PTC) resistor is respectively coupled, via a serially connected capacitor, to complete a circuit for supplying current to, and hence heating, the resistively heated cathodes. Examples of ballast circuits utilizing PTC resistors can be found in U.S. Pat. Nos. 4,647,817; 4,782,268 and 5,122,712.

The PTC resistor initially conducts current at one impedance level, and increases in impedance level as it becomes heated through dissipating energy. Thus, when the lamp ballast circuit is initially energized, a relatively high current flows through the PTC resistor, and hence through the resistively heated cathodes. Such rapid heating occurs during a cathode pre-heat period, before lamp turn-on, to achieve a desirably high temperature of the lamp cathodes for initiating lamp turn-on. The PTC resistor is chosen so that it transitions to a high impedance state near the end of the cathode pre-heat period, when it allows the lamp voltage to increase to a point sufficient to initiate lamp turn-on. Thereafter, during steady state lamp operation, the lamp voltage falls to a substantially lower level than during the cathode pre-heat period. During this steady state lamp operation, a reduced current flows through the resistively heated cathodes, resulting in less power dissipation in the PTC resistor of, for instance, on the order of 1 watt for a 20-watt lamp ballast circuit, representing a considerable energy inefficiency, of about 5%.

It would, therefore, be desirable to provide a ballast circuit for a cathode-heated type of gas discharge lamp that realizes a higher power efficiency during steady state lamp operation.

A further drawback of the above-described ballast circuit is the limited range of resistively heated cathodes for which a given PTC resistor is applicable. Such resistively heated cathodes are required in a variety of types (e.g. 2-ohm, 6-ohm, etc.), to accommodate different types of lamps. Cathode heating circuitry that is more adaptable to different types of resistively heated cathodes would thus be desirable, to more easily accommodate a greater variety of lamp types.

Moreover, it would be desirable to provide the foregoing advantages without the addition of expensive or of bulky circuitry. The avoidance of bulky circuitry is especially important for a class of compact, low pressure fluorescent lamps that employ a standard Edison-type screw base, for installation in a conventional lamp socket also accommodating incandescent lamps, and that employ a compact, multi-axis envelope, or discharge vessel, in which light is emitted from a suitable fill that is electrically excited to a discharge state. The ballast circuit for such compact fluorescent lamp is compactly contained in, and immediately adjacent, the Edison-type screw base, and is thus under rigid size constraints.

OBJECTS AND SUMMARY OF THE INVENTION

Accordingly, it is an object of the present invention to provide, for a cathode-heated type of gas discharge lamp, a ballast circuit that employs highly efficient cathode heating circuitry that is considerably more adaptable to different types of cathodes than is the case for the prior art cathode heating circuitry described above.

A further object of the invention is to provide, for a cathode-heated type of gas discharge lamp, a ballast circuit achieving the foregoing objects, without the addition of expensive or of bulky circuitry.

In accordance with the invention, there is provided a ballast circuit for a gas discharge lamp of the type having a pair of resistively heated cathodes that are resistively heated both during a cathode pre-heat period prior to lamp turn-on, and during steady state lamp operation. The ballast circuit includes means for providing, on a bus conductor, a d.c. bus voltage with respect to a ground, and a converter, responsive to the d.c. bus voltage, for supplying bidirectional current to a resonant load circuit. The resonant load circuit includes the gas discharge lamp, a resonant capacitor coupled between the lamp cathodes such that its voltage varies with lamp voltage, and a resonant inductor serially coupled to the resonant capacitor and cooperating therewith to set a frequency of resonance of, and magnitude of, the bidirectional lamp current. Means are provided for powering the resistively heated lamp cathodes, to thereby heat such cathodes. Further included is a circuit for maintaining the lamp voltage during a cathode pre-heat period below a predetermined level so as to prevent lamp turn-on during such period; such circuit includes means for holding a first cathode-of the lamp at a substantially constant voltage, and means for clamping a second cathode of the lamp below the predetermined level.

Such clamping means include a positive temperature coefficient (PTC) impedance device, such as a PTC resistor, coupled to a second cathode of the lamp, and serially connected by a positively poled clamping diode to the bus conductor, and serially connected by a negatively poled clamping diode to the ground.

BRIEF DESCRIPTION OF THE DRAWING FIGURES

The foregoing, and further, objects and advantages of the invention will become apparent from the following description taken in conjunction with the drawing, in which.

Figure 3:
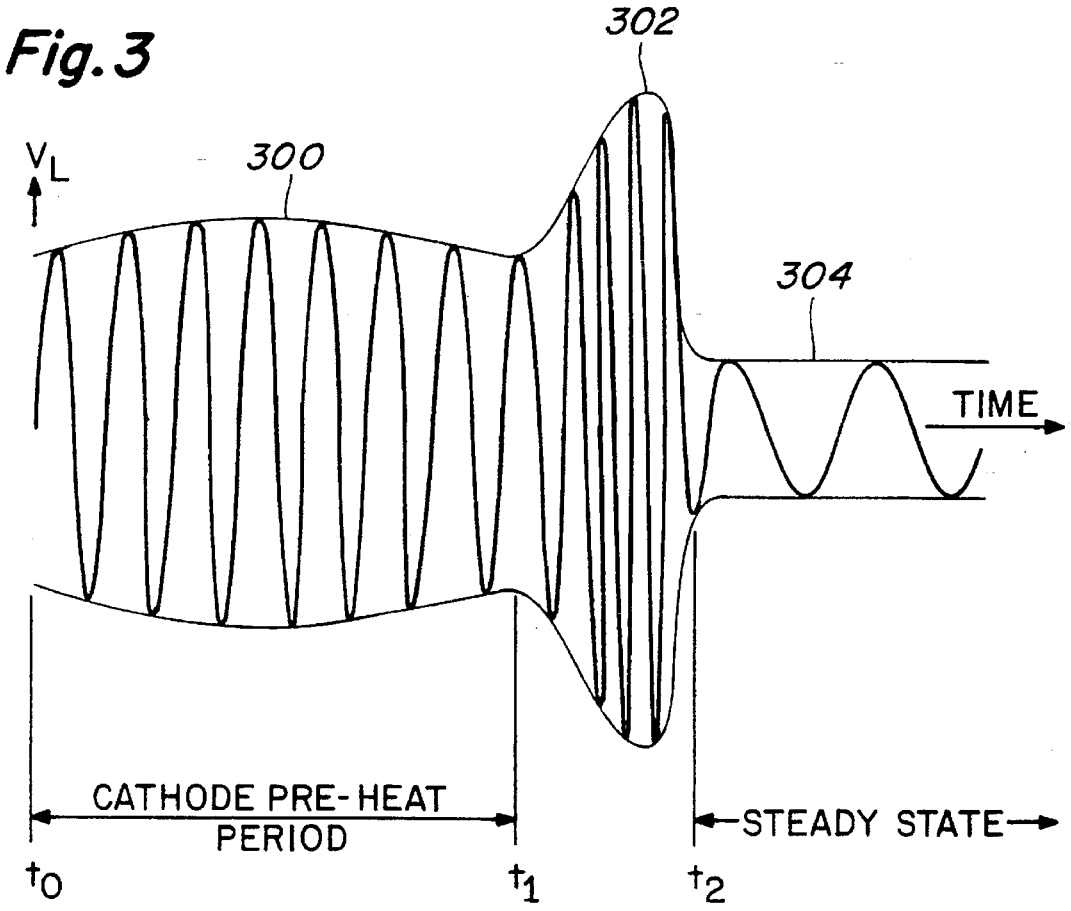

FIG. 3 plots lamp voltage over time during a cathode pre-heat period, during lamp turn-on, and at the start of steady state lamp operation.

Figure 4:
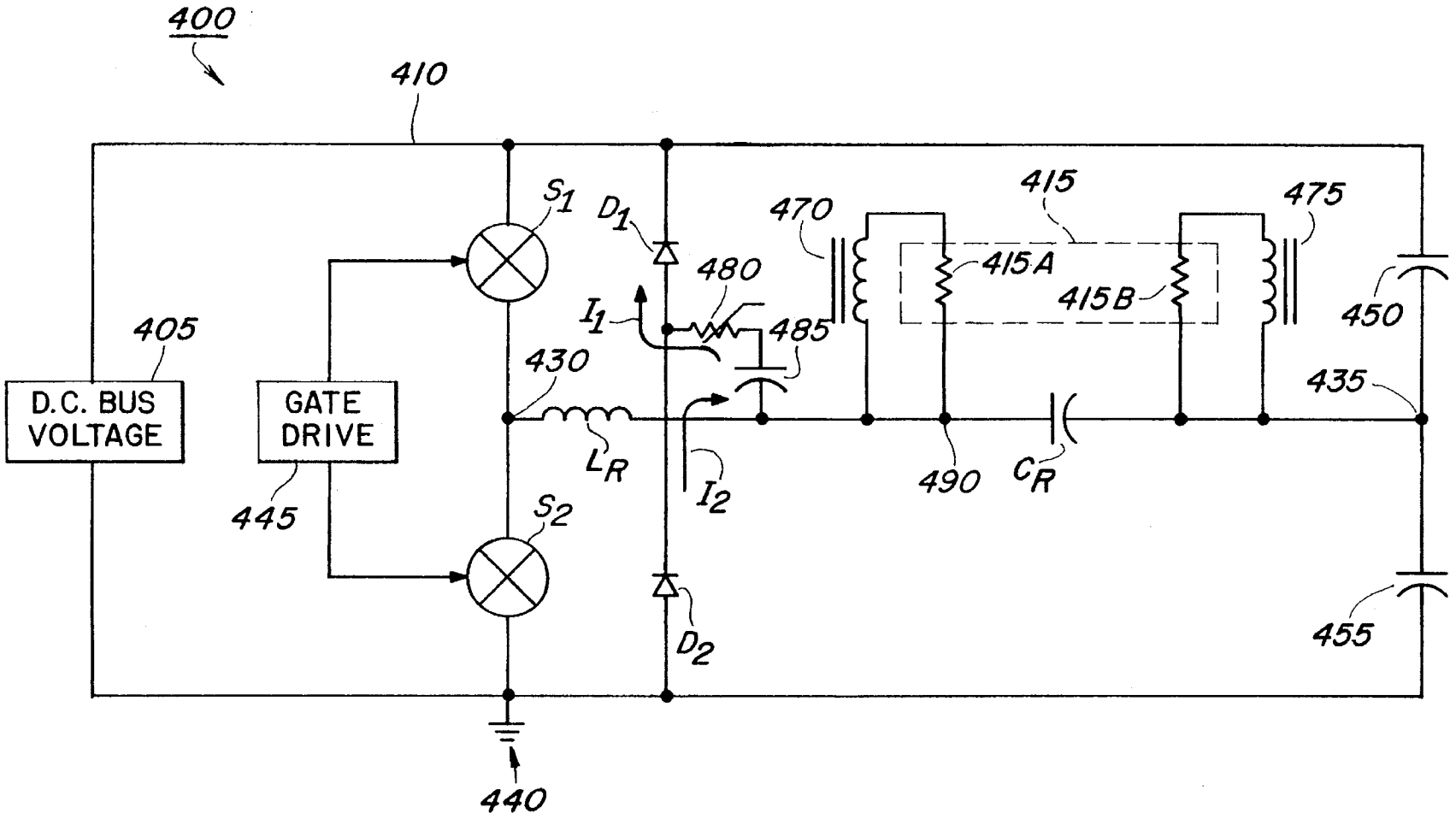

FIG. 4 is a schematic diagram, partially in block form, of a lamp and lamp ballast circuit incorporating cathode heating circuitry in accordance with a first embodiment of the invention.

Figure 5:
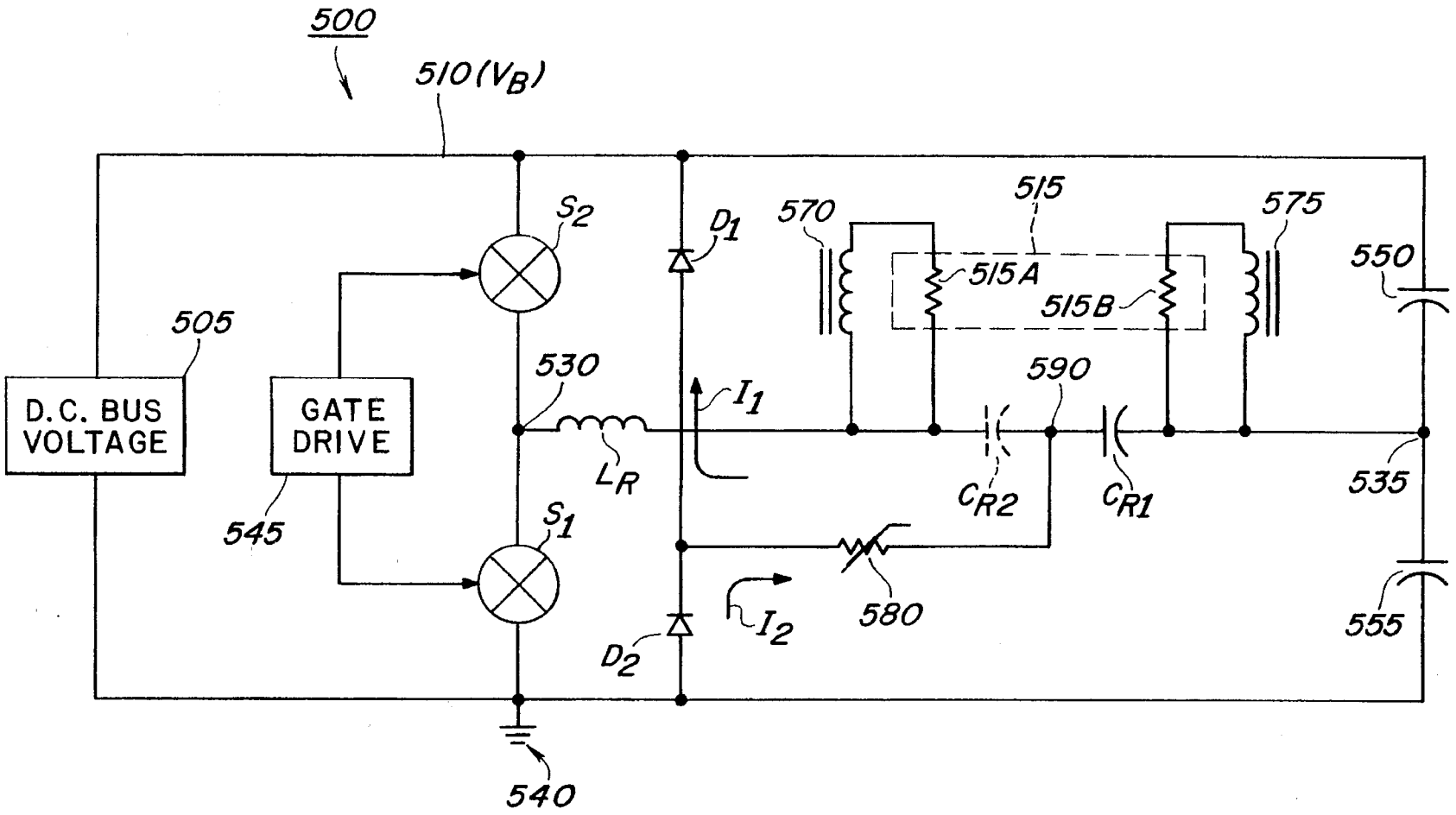

FIG. 5 is a schematic diagram, partially in block form, of a lamp and lamp ballast circuit incorporating cathode heating circuitry in accordance with a second embodiment of the invention.

DETAILED DESCRIPTION OF THE PREFERRED EMBODIMENTS

Figure 1:
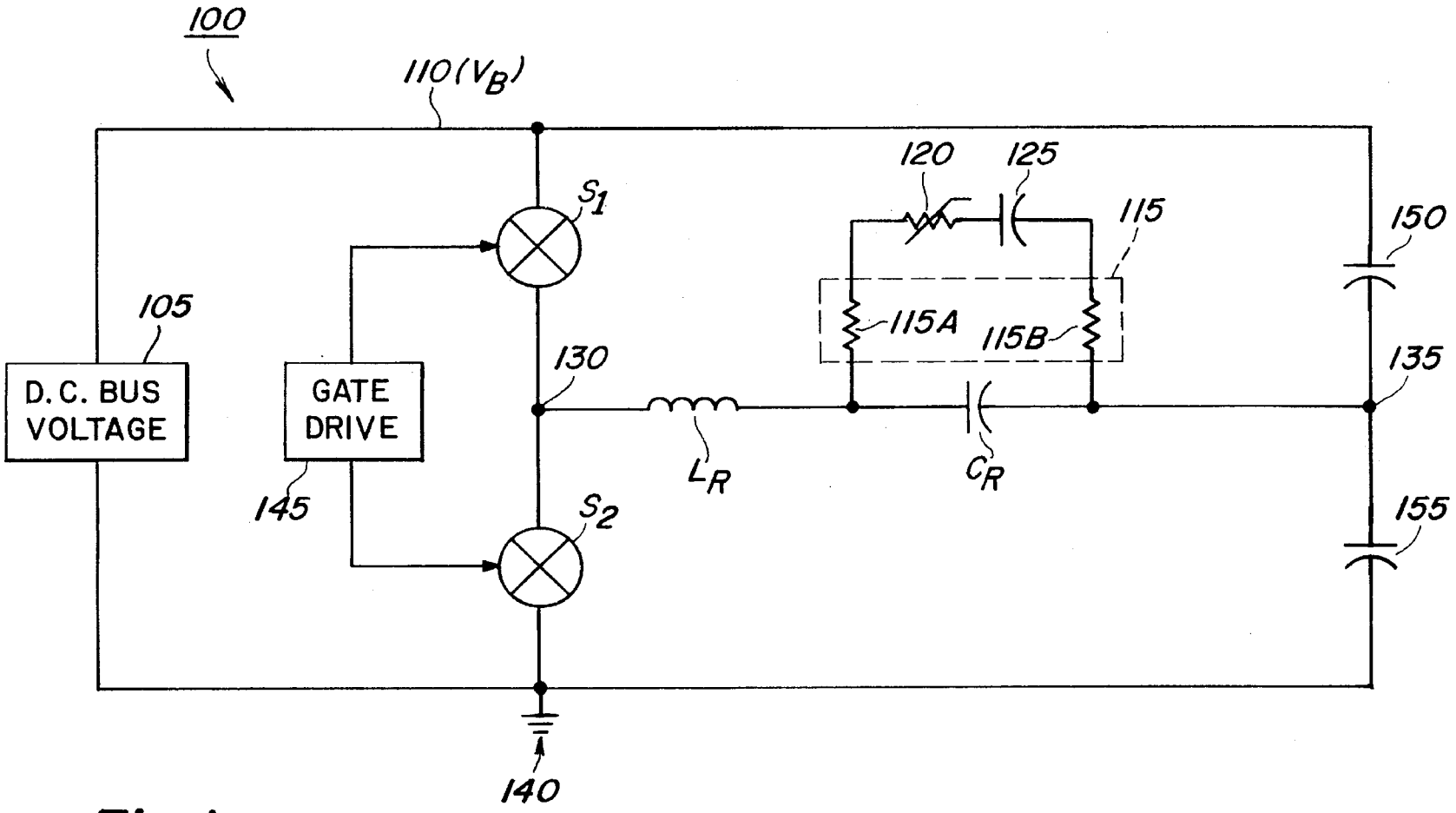
Fig. 1 (PRIOR ART)
FIG. 1 is a schematic diagram, partially in block form, of a lamp and lamp ballast circuit incorporating cathode heating circuitry in accordance with the prior art.

FIG. 1 shows a prior art circuit 100, whose explanation, as follows, will aid in understanding the invention described below. Circuit 100 includes a source 105 of d.c. bus voltage, for producing a bus voltage $V_B$ on a bus conductor 110. Typically, source 105 of d.c. bus voltage includes a full-wave rectifier, for rectifying an a.c. line voltage, and, optionally, a power factor correction circuit, such as are known in the art. Meanwhile, a gas discharge lamp 115, such as a compact, low pressure fluorescent lamp, is contained in a resonant load circuit that includes a resonant capacitor $C_R$ shunted, or placed in parallel, across the lamp, and a resonant inductor $L_R$ serially connected to the thus-paralleled lamp and resonant capacitor. A serial circuit including a positive temperature coefficient (PTC) resistor 120 and a capacitor 125, is shunted, or paralleled across, lamp 115, for heating the lamp cathodes, as discussed below.

The described resonant load circuit, which is connected between circuit nodes 130 and 135, is then provided with bidirectional current, in the following manner. Circuit node 130 is common to serially connected switches $S_1$ and $S_2$, such as MOSFETs, or Bipolar Junction Transistors (BJTs), which switches are in turn connected between bus conductor 110 and a ground, shown at 140. Gate drive circuitry 145 turns on (i.e. makes conductive between the upper- and the lower-shown, vertically oriented switch terminals) switches $S_1$ and $S_2$, in alternate succession. Thus, when switch $S_1$ is on (and $S_2$ off), circuit node 130 is brought to the potential of bus conductor 110; and when, next, switch $S_2$ is off (and $S_1$ on) circuit node 130 is brought to the potential of ground 140. Meanwhile, the right-positioned node 135 is maintained at a substantially constant voltage of typically ½ of bus voltage $V_B$, appearing on bus conductor 110; this may be accomplished with the use of capacitor 150, connected between node 135 and bus conductor 110, and capacitor 155, connected between node 135 and ground. Bidirectional current is thus provided to lamp 115 via resonant inductor $L_R$, through the mentioned function of switches $S_1$ and $S_2$ alternately connecting node 130 to bus conductor 110 and to ground.

Gate drive circuitry 145 typically is of the so-called, self-resonant type, which utilizes feedback from the described resonant load circuit to generate suitable signals for controlling switches $S_1$ and $S_2$.

Lamp 115 contains a resistively heated cathode 115A, and a resistively heated cathode 115B. An enclosed glass envelope of lamp 115 is shown in dashed lines as enclosing resistively heated cathodes 115A and 115B. The lower-shown terminal of the resistively heated elements extend downwardly from lamp 115, to connect to respective ends of resonant capacitor $C_R$. The upper-shown ends of the resistively heated cathodes are then connected to respective sides of the serial circuit including PTC resistor 120 and capacitor 125.

Figure 2:
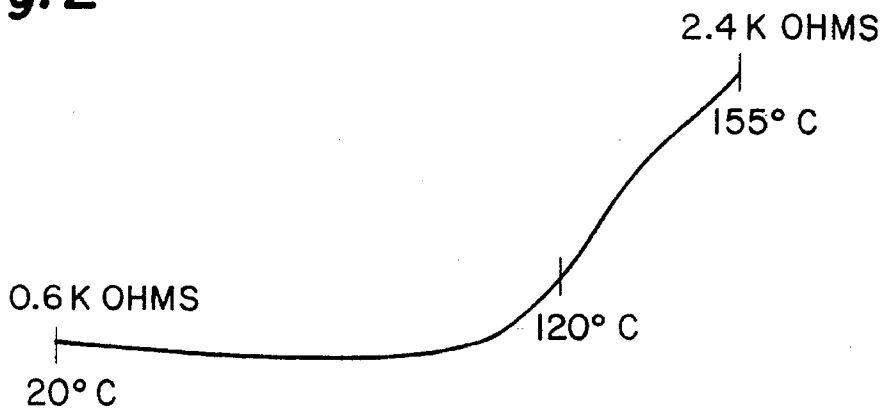
FIG. 2 is a curve showing the impedance value of a positive temperature coefficient (PTC) resistor, in ohms, versus temperature of the resistor in degrees Centigrade (C), for a 50 kHz current in the PTC resistor.

PTC resistor 120 and capacitor 125 cooperate to obtain a desired heating profile of lamp cathodes 115A and 115B, as follows. The operation of a PTC resistor is illustrated in FIG. 2, showing the variation of impedance of the device as a function of device temperature. The exemplary curve of FIG. 2 is for a PTC resistor having a rating of 0.6 k ohms at a typical 20° C. ambient temperature, and a rating of 1.8 k ohms when heated to 135° C., for a 50 kHz current in the resistor. The impedance of PTC resistor 120 is frequency dependant, owing to parasitic capacitance in the device. Such a PTC resistor will typically start to rapidly increase in impedance value when heated above about 120° C. from current conduction through the resistor. The duration of time it takes for such a PTC resistor to heat from a typical ambient temperature of 20° C., to the mentioned point where its impedance starts to rapidly increase, e.g. 120° C., is utilized, in overview, to limit the lamp voltage during a cathode pre-heat period, thereby delaying lamp turn-on until the lamp cathodes have reached a desirably high temperature, as mentioned in the "Background of the Invention," above.

FIG. 3 plots lamp voltage $V_L$ over time, to illustrate lamp voltage during the cathode pre-heat period, during lamp turn-on, and during the start of steady state lamp operation. The lamp voltage, which is approximately sinusoidal, defines an envelope 300 of peak voltage, as shown. The cathode pre-heat is shown occurring between an initial time $t_0$, e.g. when power is initially applied to the lamp, and when the PTC resistor is at an ambient temperature of 20°, for instance, as shown in FIG. 2, and time $t_1$, when PTC resistor 120 starts to rapidly increase its impedance after it reaches 120° C., for instance, as further shown in FIG. 2. The duration of the cathode pre-heat period is typically on the order of 0.5 seconds.

During the cathode pre-heat period, the impedance of PTC resistor 120 remains near its lower range of, e.g., 0.6 k ohms, and "loads" the resonant circuit formed by resonant inductor $L_R$ and the paralleled resonant capacitor $C_R$ and lamp. During the cathode pre-heat period, PTC resistor 120 dissipates considerable energy, since the lamp voltage impressed across PTC resistor 120 and capacitor 125 is high, relative to steady state lamp voltage, and the impedance of the PTC resistor is at its lowest value. The excursions of lamp voltage during the cathode pre-heat period is further controlled through selection of the value of capacitor 125.

Starting at time $t_1$ in FIG. 3, PTC resistor 120 begins to rapidly increase in impedance thereby allowing the lamp voltage to increase sufficiently to cause lamp turn-on at a transition voltage, shown at point 302 of voltage envelope 300. The lamp voltage then drops considerably to the steady state value as shown at level 304, at time $t_2$.

During steady state lamp operation, cathodes 115A and 115B of the lamp are continuously heated to 500° C., for instance, to achieve a desired thermionic emission of electrons from the cathodes, and long cathode life, as described in the "Background of the Invention," above. To achieve this, PTC resistor 120 conducts current during steady state lamp operation, to complete a circuit providing electrical power to lamp cathodes 115A and 115B. Since the lamp voltage falls to a relatively low level during steady state operation, as depicted in FIG. 3, PTC resistor 120 will operate at a relatively lower temperature during such steady state mode; it will, however, still dissipate on the order of 1 watt of power, which lowers the efficiency of a 20 watt lamp considerably, by about 5%.

The cathode pre-heat circuitry of prior art FIG. 1, i.e. PTC resistor 120 and capacitor 125, additionally suffer from having a narrow range of application to various types of lamp cathodes to be heated, which vary, for instance, in resistance levels, e.g., 2 ohms, 6 ohms, etc. It would thus be desirable for a lamp ballast circuit to incorporate cathode pre-heat circuitry that is more adaptable to a greater range of cathodes types to be heated.

The foregoing drawbacks, of continuous power drain by cathode heating circuitry, and lack of adaptability of such circuitry to different types of lamp cathodes, are overcome by the present invention, one embodiment of which is shown as circuit 400 of FIG. 4. In FIG. 4, like reference numerals refer to like parts with respect to FIG. 1 (e.g. source 405 of d.c. bus voltage is like source 105 of d.c. bus voltage). Thus, as in FIG. 1, bidirectional current in FIG. 4 is supplied to the resonant load circuit including resonant inductor $L_R$, resonant capacitor $C_R$ and lamp 415, by the alternate connection of left-shown node 430 to bus conductor 410, at the potential of bus voltage $V_B$, and then to ground, with right-shown node 435 being maintained at a substantially constant voltage of typically ½ of the bus voltage $V_B$.

Lamp 415, however, has its resistively heated cathode 415A powered by a secondary transformer winding 470 that is shunted across resistive heating element 415A. Winding 470 is coupled preferably to resonant inductor $L_R$. Similarly, resistively heated cathode 415B of the lamp is shunted by a secondary winding 475, also coupled preferably to resonant inductor $L_R$. Lamp cathodes 415A and 415B are driven harder during a cathode pre-heat period when the voltage across resonant inductor $L_R$ is relatively high, compared to a lower voltage across the inductor during steady state lamp operation, when the lamp loads the resonant circuit.

Inventive circuit 400 takes advantage of the temperature-dependency-of-impedance characteristics of a PTC resistor 480, such as illustrated in FIG. 2, for instance. PTC resistor 480 is coupled to cathode 415A of the lamp via a capacitor 485. The other end of PTC resistor 480 is connected to bus conductor 410 via a positively poled clamping diode $D_1$, and is further connected to ground 440 via a negatively poled diode $D_2$. Reference may be added to the FIG. 3 plot of lamp voltage over time, which will have a similar envelope 300 for the present circuit, although, during the cathode pre-heat period, the peak lamp voltage will be clamped, or limited, by the operation of clamping diodes $D_1$ and $D_2$, in a manner now described.

Starting at time $t_0$ in FIG. 3, PTC resistor 480 starts at a typical ambient temperature of 20° C., as shown in FIG. 2. PTC resistor 480 maintains its lower impedance value of 0.6 k ohms, for instance, until time $t_1$ in FIG. 3, when the resistor has reached a temperature where its impedance rapidly increases, e.g. 120° C. (FIG. 2). During such cathode pre-heat period between times $t_0$ and $t_1$ in FIG. 3, capacitor 485 cooperates with PTC resistor 480 to maintain a desirably low lamp voltage.

When the potential of node 490, connected to lamp cathode 415A, is above bus voltage $V_B$, clamping diode $D_1$ conducts and a current $I_1$ flows through PTC resistor 480 and clamping diode $D_1$. In this state, the anode-to-cathode voltage drop across diode $D_1$ is fixed at a low level, typically about 0.7 volts for a clamping diode embodied as a p-n diode. (A similar low forward voltage drop can be obtained with other electronic devices other than p-n diodes, as will be apparent to those skilled in the art, whereby the more general term "clamping diode" is used occasionally herein.) Cathode 415A of the lamp is thus clamped to some voltage below bus voltage $V_B$ while current $I_1$ flows through clamping diode $D_1$. During this time, the voltage of right-node 435 remains substantially constant. For the purposes of this invention, a "substantially constant" voltage on lamp cathode 415B is a voltage sufficiently constant to permit the mentioned clamping of voltage on lamp cathode 415A to a sufficiently low level to prevent lamp turn-on during the cathode pre-heat period.

When the potential of node 490 falls below the potential of ground 440, clamping diode $D_2$ conducts and a current $I_2$ flows through PTC resistor 480, in opposite direction to above-described current $I_1$, such that a fixed anode-to-cathode voltage drop exists across diode $D_2$. In this state, lamp cathode 415A is clamped to ground 440 less the voltage drops across diode $D_2$, resistor 480 and capacitor 485. Currents $I_1$ and $I_2$ alternate during the cathode pre-heat period to clamp the voltage on lamp cathode 415A, as discussed.

Once the lamp has reached steady state operation, and its voltage has decreased as shown at 304 in FIG. 3, insufficient voltage exists on lamp cathode 415A to forward bias either of the clamping diodes $D_1$ and $D_2$; consequently alternate currents $I_1$ and $I_2$ through PTC resistor 480 are no longer present, whereby no power at all is dissipated in the PTC resistor. Highly efficient cathode heating circuitry is thus realized.

Additionally, the cathode heating circuitry contained in inventive circuit 400 is considerably more versatile compared with prior art circuit 100 (FIG. 1), since it can be more readily adapted to different types of lamp cathodes. This is because, in addition to being able to select values for PTC resistor 480 and for capacitor 485, a circuit designer can select the turns ratio as between secondary windings 470 and 475, and the primary winding on resonant inductor $L_R$. Adjusting the voltage across secondary windings 470 and 475 is readily and economically accomplished, with routine skill, merely by adding or subtracting a few turns on such secondary or associated primary windings.

FIG. 5 shows a further inventive embodiment 500 of the invention, in which like reference numerals refer to like parts with respect to FIGS. 1 and 4. In FIG. 5, a PTC resistor 580 is connected to a node 590 between a first resonant capacitor $C_{R1}$ and a second resonant capacitor $C_{R2}$. As will be apparent to those skilled in the art, capacitors $C_{R1}$ and $C_{R2}$ cooperate to provide an effective resonant capacitance $C_{Reff}$ for the resonant circuit of FIG. 5:

$$C_{Reff}=C_{R1} x\ C_{R2}/(C_{R1}+C_{R2}) \quad \text{eq. (1)}$$

Second resonant capacitor $C_{R2}$ is shown in dashed lines because, for certain lamp breakdown voltages, it need not be present. With the second resonant capacitor $C_{R2}$ present, however, circuit 500 can accommodate a lamp 515 with a higher breakdown voltage level than circuit 400 for the same level of bus voltage. Thus, connecting one end of PTC resistor 580 to node 590, between capacitors $C_{R1}$ and $C_{R2}$, allows the voltage on lamp cathode 515A to be indirectly clamped, i.e., via the second resonant capacitor $C_{R2}$. This is because the voltage on node 590, the central node of the capacitive voltage divider formed by the first and second resonant capacitors $C_{R1}$ and $C_{R2}$, affects the lamp voltage appearing across the resonant capacitors. Although, as shown, circuit 500 lacks a capacitor directly corresponding to capacitor 485 of circuit 400 (FIG. 4), a circuit designer, exercising routine skill, can select the ratio of the first resonant capacitor $C_{R1}$ to the second resonant capacitor $C_{R2}$, in conjunction with PTC resistor 580, to achieve the necessary voltage-limiting function during the cathode pre-heat period shown in FIG. 3.

With regard to inventive circuit 500 of FIG. 5, for a 25-watt lamp 515 rated at 400 volts, the following component values are exemplary: PTC resistor 580 has a 20° C. impedance of 150 ohms, a thermal time constant of 13 seconds, a switching temperature of 120° C., and a heat dissipation factor of 0.0055 watts per ° C.; resonant inductor $L_R$, 1.55 millihenries; first resonant capacitor $C_{R1}$, 0.0027 microfarads; second resonant capacitor $C_{R2}$, 0.01 microfarads; capacitor 550, 0.1 microfarads; capacitor 555, 0.1 microfarads; and windings 570 and 575, 4 turns each for a primary winding in resonant inductor $L_R$ of 260 turns, where lamp cathodes 515A and 515B are each 12-ohm cathodes.

In selecting component values for circuits 400 and 500, typically the bus voltage $V_B$, the parameters of a lamp, and the resonant inductor and capacitor values will be already chosen. Good results can typically be achieved in selecting PTC resistor 480 and capacitor 485 in circuit 400, and the PTC resistor 580 and the ratio between first and second resonant capacitors $C_{R1}$ and $C_{R2}$ in circuit 500, by assuming that the lamp voltage, in the absence of the above-described clamping effect, is a perfect sinusoidal waveform.

From the foregoing, it will be appreciated that the invention provides, for a cathode-heated type of gas discharge lamp, a ballast circuit that employs cathode heating circuitry that is considerably more efficient, and more adaptable to different types of cathodes, than the prior art cathode heating circuitry described above. Moreover, this is achieved without the addition of expensive or of bulky circuitry.

While the invention has been described with respect to specific embodiments by way of illustration, many modifications and changes will occur to those skilled in the art. For instance, the PTC resistors described above could be replaced with other devices that also have a positive temperature coefficient. In addition, the secondary transformer winding 470 may also be coupled to a primary winding connected in series with the resonant capacitor $C_{R2}$. The ratio of starting current to run current, through $C_{R2}$ is greater than the ratio of starting voltage to run voltage across $L_R$. This would allow lower run voltages across the cathodes 515A and 515B. The net effect would be lower losses in each cathode at the expense of less cathode life. It is, therefore, to be understood that the appended claims are intended to cover all such modifications and changes as fall within the true spirit and scope of the invention.

What is claimed is:

1. A ballast circuit for a gas discharge lamp of the type having a pair of resistively heated cathodes that are heated both during a cathode pre-heat period prior to lamp turn-on, and during steady state lamp operation, said ballast circuit comprising:

(a) a source of d.c. bus voltage with respect to ground;

(b) a converter, responsive to said d.c. bus voltage, for supplying bidirectional current to a resonant load circuit;

(c) said resonant load circuit including the gas discharge lamp, a resonant capacitor coupled between said lamp cathodes such that its voltage varies with lamp voltage, and a resonant inductor serially coupled to said resonant capacitor and cooperating therewith to set a magnitude, and resonant frequency, of the bidirectional lamp current;

(d) means for powering the resistively heated lamp cathodes, to thereby heat said cathodes; and (e) a circuit for maintaining the lamp voltage during a cathode pre-heat period below a predetermined level so as to prevent lamp turn-on during said period, said circuit including:

(i) a constant voltage circuit coupled to a first cathode of said lamp and effective so as to hold said first cathode at a substantially constant voltage;

(ii) a clamping circuit coupled to a second cathode of said lamp and effective so as to clamp said second cathode to a voltage below said predetermined level, said clamping circuit including a positive temperature coefficient (PTC) device coupled to said second cathode of said lamp, and serially connected by a positively poled clamping diode to said bus conductor, and serially connected by a negatively poled clamping diode to said ground; and (f) wherein said means for powering the resistively heated lamp cathodes comprises, for each cathode, a respective inductor winding mutually coupled to said resonant inductor, and forming a serial circuit with such cathode.

2. The lamp ballast circuit of claim 1, in combination with the gas discharge lamp comprising a fluorescent lamp.

3. The lamp ballast circuit of claim 1, wherein said PTC impedance device comprises a PTC resistor.

4. The lamp ballast circuit of claim 1, wherein a second resonant capacitor is coupled between said lamp cathodes, in serial connection to said first-mentioned resonant capacitor, such that said serially connected capacitors both cooperate with said resonant inductor in setting the magnitude, and resonant frequency, of the bidirectional lamp current.

5. The lamp ballast circuit of claim 4, wherein said converter includes a pair of switches serially connected between said bus conductor and ground, and sharing a common node that is coupled to said resonant load circuit.

6. The lamp ballast circuit of claim 1, wherein said clamping circuit further includes a capacitor serially connected to said PTC impedance device, between an end of said resonant capacitor and said clamping diodes, for setting the value of lamp voltage during the cathode pre-heat period.

7. The lamp ballast circuit of claim 6, wherein said converter includes a pair of switches serially connected between said bus conductor and ground, and sharing a common node that is coupled to said resonant load circuit.

8. The lamp ballast circuit of claim 1, wherein said converter includes a pair of switches serially connected between said bus conductor and ground, and sharing a common node that is coupled to said resonant load circuit.

9. A ballast circuit for a gas discharge lamp of the type having a pair of resistively heated cathodes that are heated both during a cathode pre-heat period prior to lamp turn-on, and during steady state lamp operation, said ballast circuit comprising:

(a) a source of d.c. bus voltage with respect to ground;

(b) a converter, responsive to said d.c. bus voltage, for supplying bidirectional current to a resonant load circuit; said converter including a pair of switches serially connected between said bus conductor and ground, and sharing a common node that is coupled to said resonant load circuit;

(c) said resonant load circuit including the gas discharge lamp, a resonant capacitor coupled between said lamp cathodes such that its voltage varies with lamp voltage, and a resonant inductor serially coupled to said resonant capacitor and cooperating therewith to set a magnitude, and resonant frequency, of the bidirectional lamp current;

(d) wherein said resistively heated lamp cathodes are powered to thereby heat the cathodes by respective inductor windings mutually coupled to said resonant inductor, and forming a serial circuit with each of said cathodes; and (e) a circuit for maintaining the lamp voltage during a cathode pre-heat period below a predetermined level so as to prevent lamp turn-on during said period, said circuit including:

(i) a constant voltage circuit for holding a first cathode of said lamp at a substantially constant voltage; and (ii) a clamping circuit for clamping a second cathode of said lamp below said predetermined level, said circuit including a positive temperature coefficient (PTC) impedance device coupled to the second of said pair of cathodes of said lamp, and serially connected by a positively poled clamping diode to said bus conductor, and serially connected by a negatively poled clamping diode to said ground.

10. The ballast circuit of claim 9, in combination with the gas discharge lamp which comprises a fluorescent lamp.

11. The ballast circuit of claim 9, wherein said PTC impedance device comprises a PTC resistor.

12. The lamp ballast circuit of claim 9, wherein a second resonant capacitor is coupled between said lamp cathodes, in serial connection to said first-mentioned resonant capacitor, such that said serially connected capacitors both cooperate with said resonant inductor in setting a magnitude, and resonant frequency, of the bidirectional lamp current.

13. The lamp ballast circuit of claim 9, wherein said clamping circuit further includes a capacitor serially connected to said PTC impedance device, between an end of said resonant capacitor and said clamping diodes, for setting the value of lamp voltage during the cathode pre-heat period.

* * * * *